US008891796B2

(12) United States Patent
van Halteren

(10) Patent No.: US 8,891,796 B2
(45) Date of Patent: Nov. 18, 2014

(54) APPARATUS AND A METHOD FOR PROVIDING SOUND

(71) Applicant: Sonion Nederland B.V., Amsterdam (NL)

(72) Inventor: Aart Zeger van Halteren, Hobrede (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 13/719,571

(22) Filed: Dec. 19, 2012

(65) Prior Publication Data

US 2013/0163799 A1 Jun. 27, 2013

Related U.S. Application Data

(60) Provisional application No. 61/578,341, filed on Dec. 21, 2011.

(51) Int. Cl.
*H04R 25/00* (2006.01)
*H04R 25/02* (2006.01)

(52) U.S. Cl.
CPC ..... *H04R 25/02* (2013.01); *H04R 25/65* (2013.01); *H04R 2225/63* (2013.01); *H04R 25/658* (2013.01)
USPC ..... 381/330

(58) Field of Classification Search
CPC ..... H04R 25/65; H04R 2225/63; H04R 2460/11; H04R 2225/021
USPC ..... 381/312–330
See application file for complete search history.

(56) References Cited

U.S. PATENT DOCUMENTS

| | | | | |
|---|---|---|---|---|
| 6,445,799 | B1 * | 9/2002 | Taenzer et al. | 381/71.6 |
| 7,778,424 | B2 * | 8/2010 | Lange | 381/60 |
| 2011/0182452 | A1 * | 7/2011 | Lin | 381/325 |
| 2011/0255723 | A1 * | 10/2011 | Obradovic et al. | 381/328 |

FOREIGN PATENT DOCUMENTS

| | | | |
|---|---|---|---|
| WO | 2010/089422 | A2 | 8/2010 |
| WO | 2011/098153 | A1 | 8/2011 |

* cited by examiner

*Primary Examiner* — Brian Ensey
*Assistant Examiner* — Norman Yu
(74) *Attorney, Agent, or Firm* — Nixon Peabody LLP

(57) ABSTRACT

An apparatus for providing sound. The apparatus includes a sound receiver for receiving sound and outputting an output signal, a first part comprising a signal generator for generating a second signal corresponding to the output signal, a second part comprising receiving means for receiving the second signal and outputting sound corresponding to the second signal, and an element for transporting the second signal from the signal generator to the receiving means. The transporting element comprises a sound guiding channel connected to the sound receiver and for guiding sound from outside the apparatus to the sound receiver along a portion of a length of the transporting element.

14 Claims, 1 Drawing Sheet

APPARATUS AND A METHOD FOR PROVIDING SOUND

CROSS-REFERENCE TO RELATED APPLICATION

This application claims the benefit of U.S. Provisional Patent Application No. 61/578,341, filed Dec. 21, 2011, entitled "An Apparatus and a Method for Providing Sound" which is hereby incorporated by reference in its entirety.

FIELD OF THE INVENTION

The present invention relates to an apparatus and a method for providing sound and in particular to a hearing aid with a Behind The Ear (BTE) part and either an In The Canal (ITC) part or an In The Ear (ITE) part which may also have a receiver and thus be a Receiver In the Canal (RIC) part.

BACKGROUND OF THE INVENTION

BTE/RIC-combination hearing aids may be seen in e.g. WO2011/098153, which relates to a hearing aid with a new type of connector which enables the microphones positioned in the BTE part to be positioned further in front part of the BTE part.

In such apparatus, the sound receivers or microphones are positioned either in the BTE part or in the RIC part, and both positions have disadvantages. Positioning the microphone or sound receiver behind the ear, will make sound detection more difficult, especially when directionality is desired. Providing the microphone in the RIC part increases the possibility of feed back from the sound fed to the ear and the microphone. The present invention aims to provide a better solution.

SUMMARY OF INVENTION

In a first aspect, the invention relates to an apparatus for providing sound, the apparatus comprising:

- a sound receiver for receiving sound and outputting an output signal,
- a first part comprising a signal generator for generating a second signal corresponding to the output signal,
- a second part comprising receiving means for receiving the second signal and outputting sound corresponding to the second signal,
- an element for transporting the second signal from the signal generator to the receiving means, wherein the transporting element comprises a sound guiding channel connected to the sound receiver and for guiding sound from outside the apparatus to the sound receiver along a portion of a length of the transporting element.

In this respect, an apparatus may be an assembled product formed by multiple parts, which may be taken apart for e.g. replacement or repair, or the parts may be permanently fixed to each other by e.g. gluing or the like. Naturally, in the extreme, the apparatus may be monolithic.

A sound receiver may be any type of element adapted to or configured to receive sound and output a signal. Elements for receiving sound and outputting an output signal may be microphones. Naturally, any basic technology may be used, such as moving armature, moving coil, MEMS microphones or the like. In addition, optical microphones can be applied. These e.g. provide a direct optical coupling by means of a membrane/compliant part in the tubing coupled to an interferometer, allowing a signal representing sound is transmitted optically.

The sound receiver outputs an output signal corresponding to the sound received. In this respect the "corresponding to" will be an output signal generated from the received sound, even though this output signal may be filtered, altered or the like due to the operation of the sound receiver and/or electronics and/or circuits receiving an output of the sound receiver and processing the signal output to generate the output signal. This processing typically would be an amplification, but also filtering in order to take into account imperfections in the sound receiver and/or a hearing disorder of a user or intended user of the apparatus.

The first part may be detachable from the second part and/or the transporting element or may be permanently fixed thereto. The first and second parts preferably have separate housings.

The first part may be shaped to fit behind the ear of a person and may itself or via the transporting element be shaped (such as with a U-shape) so as to extend between the pinna of the ear and the persons skull, i.e. over the "inner-most parts" of the ear, so as to stay in place due to its shape. In this manner, the transporting element may naturally be aimed at the ear canal and the second part.

The first part has a signal generator which is able to receive the output signal and provide or generate a second signal corresponding to the output signal. In this respect, the "corresponding to" may, as is also the situation with the output signal, be a signal with the same frequency contents or a signal with altered frequency contents. As is the situation with the sound receiver, the signal generator may be able to amplify and/or filter the signal in order to provide certain features or advantages in the output signal or in order to take into account imperfections, disadvantages or the like of other elements, such as the sound receiver, the transporting element, the receiving means, the sound outputting means and/or the sound guiding channel. Thus, the signal generator may be adapted to ensure that the sound output by the sound outputting means has predetermined or sought for characteristics in spite of or independently of any imperfections, filtrations etc. performed by the other elements.

The major reason for providing the signal generator in the first part is that this often requires a battery, which is space consuming, and that there is more room for this behind the ear of the person than in the ear canal or close thereto, when it is desired that both parts of the apparatus are as invisible as possible.

The second signal output or generated by the signal generator may be an electric signal, an optical signal and/or an (acoustic) sound signal. This will be described in further detail below.

The second part may be detachable from the first part and/or the transporting element or may be permanently fixed thereto.

The second part is preferably adapted to, shaped so as to or configured to be provided in the ear canal of the person or at the ear canal, such as provided in or at the concha and/or at or behind the Tragus/Anti Tragus so as to be able to direct the sound output into or toward the ear canal. In may cases, the second part is individually fitted to the ear, outer ear and/or ear canal of the individual ear and of the individual user, where one side of the second part is adapted to, such as shaped to, engage, touch or contact the ear/ear canal of the user and another side thereof points away from the first side and faces surroundings of the user's ear. Then, the receiving means may have an opening at the one side for outputting the sound, so that sound output thereof can be directed to or toward the ear canal of the user during normal use/operation, and, at the other side, means may exist for engaging with or fixing to the transporting element so as to receive the second signal.

The second part has a receiving means adapted to or configured to receive the second signal, which may be an acoustic sound signal or an electrical/optical signal.

If the second signal is a sound signal, the signal generator is positioned in the first part, and the receiving means may simply receive this sound signal and forward it to or toward an output or opening thereof, which is preferably, during normal use, directed to or toward the ear canal of a user.

In an alternative embodiment, wherein the second signal is an electric or optical signal, the receiving means comprises a sound generator and are adapted to receive the electric or optical signal and feed this signal to the sound generator which then generates sound, which is output by the receiving means. In such alternative embodiment, the signal generator may be positioned in the second part.

The sound output by (received by or generated by) the receiving means "corresponds" to the second signal. As is described above, the different signals may be amplified and filtered in order to take imperfections etc. into account. In principle, this adaptation may be performed in any step or in any means of the apparatus. Thus, the receiving means may also perform an alteration of the second signal when, before or after any conversion thereof to a sound signal, if the second signal is not a sound signal.

If the second signal is a sound signal, this sound signal may also be altered by feeding it through e.g. a channel or other conducting element which, by its very nature, may alter the sound transported therein. This is standard knowledge for the skilled person.

If the second signal is an electric/optical signal, this signal may be adapted before conversion into sound, and/or the sound generated may be altered, if desired.

The apparatus comprises an element for transporting the second signal from the signal generator to the receiving means. This transporting element may be an elongated, hollow tube for transporting sound or for holding one or more electrical wires and/or optical fibres. Naturally, both sound and wires/fibres may be used. Wires/fibres may also themselves form the transporting element, as these need not be held in anything to perform their function.

In many embodiments, the transporting means has the additional purpose of aiding in the positioning and maintaining the position of the first part behind or on the ear of the person by having a predetermined shape, typically one or more bends, one of which is adapted to extend over the ear of the person to obtain a hook-like shape by itself or together with the first part.

Preferably, the transporting means is pliable, bendable and/or soft in order for it to allow the first and second parts to move independently of each other, such as during fitting to the ear of a person or during use.

According to the invention, the transporting element further comprises a sound guiding channel connected to the sound receiver and which is adapted to or configured to guide sound from outside the apparatus to the sound receiver along a portion of a length of the transporting element.

In this respect, the sound guiding channel preferably, at least along a predominant portion of its length, is a closed (tubular) channel. In one embodiment the channel has openings only at its ends, one opening into or toward the sound receiver and the other being provided at a predetermined position between the first and second parts.

The length of the transporting element is the length thereof between the first and second parts. Naturally, the transporting element need not be, and is usually not, straight, but the length could be that of the transporting element when straightened.

The portion of the length may be any percentage of the length, such as between 5 and 90% of the length, preferably between such between 5 and 15% of the length, as it may be seen as an advantage to provide the sound receiver as much as possible in front of e.g. a BTE element, so that the transporting means, which may be a tube, is bent, and the sound guiding channel may guide the sound toward or to the first or the second part, depending on where the sound receiver is positioned. Naturally, the sound receiver may be provided in any of the first and second parts, and embodiments exist in which one or more sound receivers are provided in both the first and the second parts.

When the sound guiding channel extends along a portion of the length of the transporting element, the sound guiding channel preferably is connected to, such as made monolithically with, the transporting element. Then, the sound guiding channel may be moulded or shaped in the same step as the remainder of the transporting element. In a preferred embodiment, the transporting element has, in addition to the sound guiding channel, another channel for carrying the second signal in the shape of sound or via electrical wires or optical fibre(s) therein, where the two channels are extruded in the same step, where after the length of the sound guiding channel is adapted by removing part of the material forming this channel.

Thus, the sound guiding channel preferably follows or neighbours the transporting element along its full length. Alternatively, the sound guiding element may follow the remainder of the transporting element only a portion of the length of the sound guiding channel, where the sound guiding channel, at an end thereof distally from the sound receiver, extends a predetermined distance away from the remainder of the transporting element. This end portion may extend away from the remainder of the transporting element and/or the head of the user in order to avoid interference, "shadow" effects or reflections there from.

Preferably, transporting element may be 40-80 mm in length and have an outer diameter of 0.8-3 mm, where the sound guiding channel may have a length of 0-40 mm. In one embodiment, the openings are 3-25 mm from the first part. Preferably, the openings are so small that they are not visible or very hardly visible, such as 0.3-1 mm of diameter. The preferred materials for the transporting element are PEBAX polyether block amides (available from Arkema) or nylon-like materials.

In this context, the "outside of the apparatus" from which the sound to be guided is received is the surroundings of the apparatus, such as the space in which the apparatus exists. This space may be a room, a vehicle or outdoors, depending on the actual use of the apparatus and the whereabouts of the user at the point in time.

In one embodiment, the transporting element has one or more openings from inside the channel to outside the channel for sound to enter the channel and be guided to the sound receiver. An alternative to this embodiment is one in which a membrane or other pliable element is provided through which or via which the sound from the surroundings may enter the sound guiding channel. The advantage of using a membrane is the preventing of dirt, sweat or the like from entering into the channel, but a membrane tends to dampen/alter the sound received.

In one embodiment, the transporting element has a plurality of openings. More, but smaller, openings may make it possible to still receive the sound relatively un-dampened, while the smaller openings make it more difficult for impurities to enter the channel.

Another manner of preventing dust etc. from entering the channel is where the transporting element has a porous material provided over at least one of the openings. This porous material may be any type of porous material, such as a woven or non-woven material, a foam, a ceramic, a material provided with a number of small holes, or the like.

In one embodiment, the transporting element has at least one bend, and wherein the sound transporting channel extends from one of the first and second part and to a position at the at least one bend or a position closer to the second part than the bend. In this situation, the bend may be adapted to be provided over a part of the ear of a person so as to keep the apparatus in place. Providing one end of the channel in front of this bend, when the apparatus is worn by a user, and where in front is a direction from the ear toward the nose of the user, the opening is provided in a desirable position away from the sound generator and closer to the position of the ear canal, where sound is normally received by persons.

Another aspect of the invention relates to a method of operating an apparatus comprising:

a sound receiver, a first part comprising a signal generator for generating a second part comprising sound receiving means for receiving the second signal and outputting sound, an element for transporting the second signal from the signal generator to the receiving means, the method comprising:

providing the transporting element with a sound guiding channel, guiding sound through the sound guiding channel and along a portion of a length of the transporting element from outside the apparatus to the sound receiver, the sound receiver receiving the sound and outputting a corresponding output signal, the signal generator receiving the output signal and generating a second signal corresponding to the output signal, the receiving means receiving the second signal and outputting sound corresponding to the second signal.

The individual elements or parts of the apparatus may be those of the first aspect of the invention.

The step of providing the transporting element with a sound guiding channel may be performed in or at the step of generating or manufacturing the transporting element. The transporting element may have a tubular or channel-formed part for transporting the second signal if it is a sound signal or for holding electrical wires or optical fibre(s), if the second signal is electrical/optical. Such parts are typically extruded, and the sound guiding channel may be extruded in the same step.

Naturally, wires/fibre(s) need not a separate channel but may be attached to the sound guiding channel. More advantageously wires may even be provided within the sound guiding channel, as this does not affect the acoustic propagation of sound in/through the guiding channel.

The sound is guided along a portion of the length of the transporting element. Then, the step of providing the transporting element with the sound guiding channel may initially comprise the step of providing the transporting element with the sound guiding channel along its full length and a subsequent step of removing the sound guiding channel at a part of the length of the remainder of the transporting element. In this manner, the initially provided element may be manufactured, such as extruded, homogeneously over its length (such as extruded or co-extruded) and then subsequently e.g. cut to length and have part of the channel forming the sound guiding channel removed.

Naturally, multiple sound guiding channels may be formed. These may be adapted to guide sound to one and the same sound receiver or different receivers which may be all positioned in the same part (first or second part), or the multiple sound receivers may be provided in both parts, where the sound guiding channels then guide sound to both parts.

Different such sound guiding elements may be adapted to receive sound at different positions along the length of the transporting element.

The sound receiver receives the sound and outputs a corresponding signal. This may be the operation of a microphone, for example. In one embodiment, the sound receiver also has a circuit which receives the signal of the microphone type element, which circuit may amplify and/or filter the signal.

The signal generator usually is a circuit, such as a DSP (digital signal processor), processor, hardwired or software programmable, FPGA (field-programmable gate array), ASIC (application specific integrated circuit) or the like, which performs filtering, adaptation, amplification or other modifications of the output signal. The signal generator may alternatively or additionally convert the output signal to another type of signal. In one embodiment, the output signal is an electrical signal, and the second signal is a sound signal.

The receiving means may receive a sound signal and output this sound or part of it, but in the situation where the second signal is not a sound signal, the receiving means comprises means for converting the second signal into a sound signal in order for sound to be output.

In one embodiment, the guiding step comprises the sound entering the channel from outside the channel to inside the channel through one or more openings therein. An alternative is the providing of a membrane, such as an airtight membrane, which may act to prevent water, sweat, debris, dust or other impurities or contaminations from entering and blocking the sound guiding channel.

In one embodiment, the entering step comprises the sound entering the channel through a porous material provided over at least one of the openings. This porous material may be a woven or non-woven material, a ceramic, a foam, a material with small holes, or the like.

In one embodiment, the guiding step comprises guiding the sound, in the sound guiding channel, along a length being between 10 and 90% of a length of the transporting element between the first and the second parts. Naturally, the sound guiding channel may guide the sound to any of the first or second parts, depending where the sound receiver is positioned.

In a preferred embodiment, the transporting element has at least one bend, and wherein the sound transporting step comprises transporting the sound to the receiver from a position at the at least one bend or a position closer to the second part than the bend. In a usual use situation where the apparatus is worn on/by a person, this bend can be provided over the ear of the user, whereby the position is one in front of the ear but above the second part and thus a suitable distance away from any sound provider provided in the second part as part of the receiving/outputting means.

A final aspect of the invention relates to a transporting element for use in the apparatus according to the first aspect of the invention, the transporting element being oblong and having a first end and a total length, comprising:

a first lumen comprising one or more electrical and/or optical conductors, the first lumen extending along a first distance of a the total length from the first end thereof, and a second lumen extending a second distance from the first end to a second end of the second lumen, the first distance exceeding the second distance, the second lumen having at least two openings from the lumen to surroundings of the transporting element, a first of the openings being at the first end of the transporting element and another opening positioned at or in the second end.

In this respect, "oblong" means that a length is more than twice a width, such as a diameter or a largest width across the longitudinal axis. The total length being the largest dimension, such as a longitudinal axis.

A "lumen" is an enclosure of the transporting element, usually having one or more openings into the lumen in order for the lumen to be able to carry acoustic signals or electrical conductors or the like. Often, a lumen will have air therein, but this is not required for the first lumen which may have therein only the conductor(s).

The first and second distances usually will co-extend along the second distance and will be along a longitudinal axis of the transporting element.

The openings of the second lumen are adapted to transport sound into and out of the second lumen. Naturally, more than two openings may be provided into the second lumen, such as 3, 4, 5 or more openings, preferably provided along a length of the second lumen, such as a in a part of the second lumen extending from a middle part thereof and toward the second opening.

Preferably, the first and second lumens are provided of the same material and are connected to each other, such as if of a monolithic material. In one embodiment, the material forming the two lumens is extruded to form the two lumens. Then, initially, the first and second lumens may extend along the full length of the transporting means, where after a part of the material forming the second lumen is removed to make the second lumen shorter than the first lumen.

BRIEF DESCRIPTION OF THE DRAWINGS

In the following, preferred embodiments of the invention will be described with reference to the drawing, wherein.

DETAILED DESCRIPTION OF PREFERRED EMBODIMENTS

Figure 1:
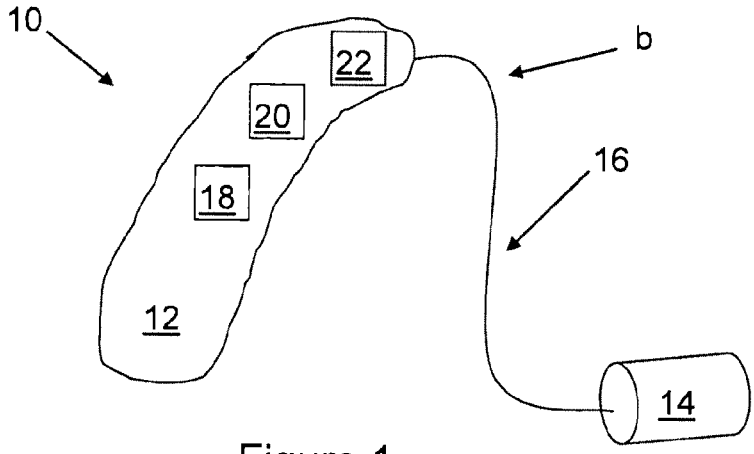
FIG. 1 illustrates the standard elements of a BTE-RIC/ITC hearing aid.

In FIG. 1, the standard elements of a BTE-RIC/ITC hearing aid 10 are illustrated. The elements are a BTE part 12, an ITE/RIC part 14 and an interconnecting tube or cable 16. In addition to these elements, one or more microphones 20 are present as is a sound provider 22.

Usually, the BTE part 12 is positioned behind the auricle of the ear, and the ITC part 14 provided in or at the ear canal of the person, where the tube/cable 16 then interconnects these elements and is provided from behind the Helix, in front thereof and toward the Tragus and the ear canal (Outer Acoustic Meatus) of the ear.

The BTE part 12 has an element 18, which normally is a processor, which receives signals from one or more microphones 20, which may be positioned in the BTE part 12 and/or the ITC part (see below) and provides a signal which is converted into sound by a sound generator 22 which may be positioned in the BTE part 12 and/or the ITC part 14 (see below).

Figure 2:
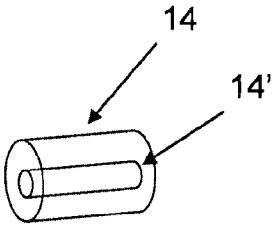
FIG. 2 illustrates an ITC part adapted to receive a sound signal and guide it to the ear canal.

Different set-ups or constellations are possible, such as one where the microphone(s) 20 and the sound provider 22 are all positioned in the BTE part 12, so that the tube/cable 16 is a hollow tube acting to guide the sound generated in the BTE part 12 to the ITC part 14, which is positioned in or at the ear canal of the person and which has a channel 14' (see FIG. 2) which guides the sound received into the ear canal.

Figure 3:
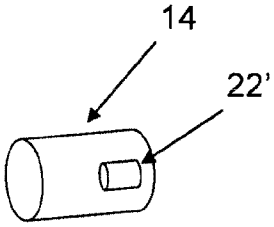
FIG. 3 illustrates an ITC part with a sound provider.

In another set-up, a microphone 20 is present in the BTE part 12, but the sound generator 22 is not present in the BTE part 12. Instead, an electric (or optical) signal is fed, via the cable 16, to a sound generator 22' (see FIG. 3) provided in the ITC part 14, which is then called a Receiver In the Canal (RIC) element, from where the sound generated is fed into the ear canal of the person.

Figure 4:
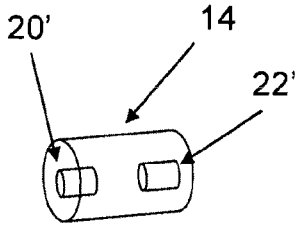
FIG. 4 illustrates an ITC part with a microphone and a sound provider.

In addition, the microphone 20, or another microphone 20', may be provided in or at the ITC part 14 (see FIG. 4), from which a signal (electrical, optical, wireless) is fed to the processor 18 of the BTE part 12 for processing and from which the sound and/or electrical/optical signal is fed to the ITC part 14.

Under all circumstances, as is described above, all of the described microphone positions have disadvantages due to their associated sound input locations.

Figure 5:
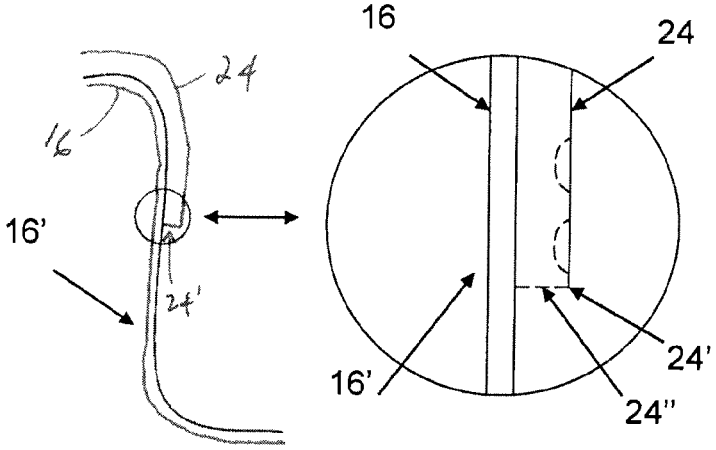
FIG. 5 illustrates a tube/cable for use in a hearing aid according to the invention.

In FIG. 5, the tube/cable 16' of a hearing aid according to the invention is described in more detail. This tube/cable has the usual tube/cable 16 for transporting electrical/optical signals or sound from the BTE part 12 to the ITC/RIC part 14. However, in addition, the tube/cable 16' has another tube 24, which has an opening 24' along the length of the tube/cable 16' away from the ends thereof, but which tube 24 is adapted to guide sound therein to one end of the tube/cable 16', where the sound may be detected by the microphone 20/20'. The manner in which the sound is detected and subsequently processed etc. may be as in the usual BTE/ITC hearing aid.

This amended tube/cable 16', however, now defines a new position of the sound entrance of the corresponding microphone, even though the actual microphone 20/20' may be positioned in any of the usual positions (BTE or ITC part).

Naturally, the opening 24' may be positioned at any position between the BTE part 12 and the ITC part 14. Also, this element may be provided with a number of features, such as features acting to prevent dust, sweat or the like from entering the tube 24.

Thus, a porous element, 24" may be provided in front of the opening 24', or the opening 24' may be provided as a number of smaller openings (indicated in hashed lines), such along a longitudinal direction of the tube 24.

Naturally, the tube/cable 16' may have multiple tubes 24, and these may extend in any of the two directions of the tube/cable 16 and thus guide sound to microphone(s) 20/20' provided in any of or both of the BTE part 12 and the ITC part 14. Multiple tubes 24 may have their openings at the same or different positions along the length of the tube/cable 16.

As to the position of the opening 24', this may be selected at any position along the tube/cable 16'. Preferably, this position is not too close to the ITC part 14, if this has a sound generator 22. Preferably, this position is not too close to the BTE part 12, as this may be a position too far behind the ear of the person.

A suitable position is at the bend b illustrated in FIG. 1, and preferably a position between the bend b and the lower bend of the tube/cable 16. This position is sufficiently far from any sound generators and is in front of the ear of the person, whereby a better sound reception of sound from in front of the person is obtained.

Figure 6:
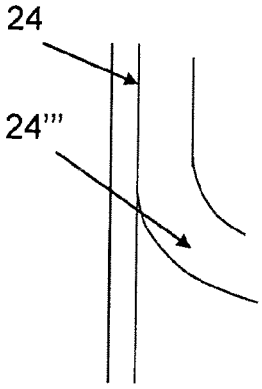
FIG. 6 illustrates a tube/cable where the sound guiding channel extends away from the remainder of the cable.

Finally, FIG. 6 illustrates an embodiment in which an end portion 24''' of the tube 24 extends slightly away from the tube/cable 16 at its distal end (away from the microphone). This extending away from may be desired, if it is e.g. experienced that sound reflects from the tube/cable 16.

In general, the tube/cable 16' may be extruded as two channels or a single channel in which wires/fibres transporting an electrical/optical signal are present, where the tube 24 then is cut to the desired length to provide the opening 24 at the desired position. In the situation where the tube 16 is also a tube, the two tubes 16 and 24 may be extruded with a narrowing there between, so that the two tubes may be severed (cut) or simply pulled from each other in order to facilitate removal of the undesired part of the tube 24. Such two-channel tubes are easily and cheaply manufactured.

The invention claimed is:

1. An apparatus for providing sound, the apparatus comprising:

a sound receiver for receiving sound and outputting an output signal, a first part comprising a signal generator for generating a second signal corresponding to the output signal, the first part being shaped to fit behind an ear of a person, a second part comprising receiving means for receiving the second signal and outputting sound corresponding to the second signal, the second part being configured to be provided in or at an ear canal of the person, an element for transporting the second signal from the signal generator to the receiving means, wherein the transporting element comprises a plurality of openings and a sound guiding channel connected to the sound receiver and for guiding sound from outside the apparatus to the sound receiver along a portion of a length of the transporting element, and wherein the transporting element has a first length between the first and the second parts, and wherein the sound guiding channel has a length being between 5% and 90% of the first length.

2. An apparatus according to claim 1, wherein the transporting element has at least one bend, and wherein the sound guiding channel extends from one of the first and second part and to a position at the at least one bend or a position closer to the second part than the bend.

3. A transporting element for use in the apparatus according to claim 1, the transporting element being oblong and having a first end and a total length, comprising:

a first lumen comprising one or more electrical and/or optical conductors, the first lumen extending along a first distance of a the total length from the first end thereof, and a second lumen extending a second distance from the first end to a second end of the second lumen, the first distance exceeding the second distance, the second lumen having at least two openings from the lumen to surroundings of the transporting element, a first of the openings being at the first end of the transporting element and another opening positioned at or in the second end.

4. The apparatus according to claim 1, wherein the transporting element includes a first lumen and a second lumen, the sound guiding channel being formed by the second lumen having a length that is no greater than 90% of a length of the first lumen.

5. An apparatus according to claim 1, wherein a diameter of each of the openings in the transporting element is between 0.3 mm and 1 mm.

6. An apparatus for providing sound, the apparatus comprising:

a sound receiver for receiving sound and outputting an output signal, a first part comprising a signal generator for generating a second signal corresponding to the output signal, the first part being shaped to fit behind an ear of a person, a second part comprising receiving means for receiving the second signal and outputting sound corresponding to the second signal, the second part being configured to be provided in or at an ear canal of the person, an element for transporting the second signal from the signal generator to the receiving means, wherein the transporting element comprises a sound guiding channel connected to the sound receiver and for guiding sound from outside the apparatus to the sound receiver along a portion of a length of the transporting element, wherein the transporting element has a plurality of openings and a porous material provided over at least one of the openings, and wherein the transporting element has a first length between the first and the second parts, and wherein the sound guiding channel has a length being between 5% and 90% of the first length.

7. An apparatus according to claim 6, wherein the transporting element has at least one bend, and wherein the sound guiding channel extends from one of the first and second part and to a position at the at least one bend or a position closer to the second part than the bend.

8. A transporting element for use in the apparatus according to claim 6, the transporting element being oblong and having a first end and a total length, comprising:

a first lumen comprising one or more electrical and/or optical conductors, the first lumen extending along a first distance of a the total length from the first end thereof, and a second lumen extending a second distance from the first end to a second end of the second lumen, the first distance exceeding the second distance, the second lumen having at least two openings from the lumen to surroundings of the transporting element, a first of the openings being at the first end of the transporting element and another opening positioned at or in the second end.

9. The apparatus according to claim 6, wherein the transporting element includes a first lumen and a second lumen, the sound guiding channel being formed by the second lumen having a length that is no greater than 90% of a length of the first lumen.

10. An apparatus according to claim 6, wherein the porous material includes a woven or non-woven material, a foam, a ceramic, or a material provided with multiple small holes.

11. A method of operating an apparatus comprising:

a sound receiver, a first part comprising a signal generator for generating a second signal, the first part being shaped to fit behind an ear of a person, a second part comprising sound receiving means for receiving the second signal and outputting sound, the second part being configured to be provided in or at an ear canal of the person, an element for transporting the second signal from the signal generator to the sound receiver, the method comprising:

providing the transporting element with a sound guiding channel, guiding sound through the sound guiding channel along a portion of a length of the transporting element from outside the apparatus to the sound receiver, the sound receiver receiving the sound and outputting a corresponding output signal, the signal generator receiving the output signal and generating a second signal corresponding to the output signal, the receiving means receiving the second signal and outputting sound corresponding to the second signal, wherein the guiding step comprises the sound entering the channel through multiple openings therein from outside the channel to inside the channel, wherein the guiding step comprises guiding the sound, in the sound guiding channel, along a length being between 5% and 90% of a length of the transporting element between the first and the second parts.

12. A method according to claim 11, wherein the transporting element has at least one bend, and wherein the sound transporting step comprises transporting the sound to the receiver from a position at the at least one bend or a position closer to the second part than the bend.

13. A transporting element for use in the apparatus according to claim 11, the transporting element being oblong and having a first end and a total length, comprising:

a first lumen comprising one or more electrical and/or optical conductors, the first lumen extending along a first distance of a the total length from the first end thereof, and a second lumen extending a second distance from the first end to a second end of the second lumen, the first distance exceeding the second distance, the second lumen having at least two openings from the lumen to surroundings of the transporting element, a first of the openings being at the first end of the transporting element and another opening positioned at or in the second end.

14. A method of operating an apparatus comprising:

a sound receiver, a first part comprising a signal generator for generating a second signal, the first part being shaped to fit behind an ear of a person, a second part comprising sound receiving means for receiving the second signal and outputting sound, the second part being configured to be provided in or at an ear canal of the person, an element for transporting the second signal from the signal generator to the sound receiver, the method comprising:

providing the transporting element with a sound guiding channel, guiding sound through the sound guiding channel along a portion of a length of the transporting element from outside the apparatus to the sound receiver, the sound receiver receiving the sound and outputting a corresponding output signal, the signal generator receiving the output signal and generating a second signal corresponding to the output signal, the receiving means receiving the second signal and outputting sound corresponding to the second signal, wherein the guiding step comprises the sound entering the channel through one or more openings therein from outside the channel to inside the channel, and wherein the entering step comprises the sound entering the channel through a porous material provided over at least one of the openings.

* * * * *